US006513308B1

(12) United States Patent
Meeuwesen et al.

(10) Patent No.: US 6,513,308 B1
(45) Date of Patent: Feb. 4, 2003

(54) DEVICE FOR MANUFACTURING TUBULAR BAG PACKAGES

(75) Inventors: Antonius Meeuwesen, Oisterwijk (NL); Johannis Lambie, St. Geertruid (NL); Adrianus Arie Vermaat, Weert (NL); Barend Bastiaan Romijn, Weert (NL)

(73) Assignee: Robert Bosch GmbH, Stuttgart (DE)

( * ) Notice: Subject to any disclaimer, the term of this patent is extended or adjusted under 35 U.S.C. 154(b) by 0 days.

(21) Appl. No.: 09/601,994

(22) PCT Filed: Dec. 16, 1999

(86) PCT No.: PCT/DE99/04000

§ 371 (c)(1),
(2), (4) Date: Sep. 26, 2000

(87) PCT Pub. No.: WO00/37245

PCT Pub. Date: Jun. 29, 2000

(30) Foreign Application Priority Data

Dec. 18, 1998 (DE) ..... 198 58 567

(51) Int. Cl.[7] ..... B65B 9/06

(52) U.S. Cl. ..... 53/551; 53/552; 493/436; 493/308; 493/302

(58) Field of Search ..... 53/451, 551, 552; 493/269, 302, 308, 310, 276, 436, 437, 439

(56) References Cited

U.S. PATENT DOCUMENTS 2,533,554 A * 12/1950 Byerly ..... 53/451
3,426,499 A * 2/1969 Paige ..... 53/551
3,434,652 A * 3/1969 Shore ..... 383/104
3,505,779 A * 4/1970 Kopp ..... 53/550
3,548,563 A * 12/1970 Leasure ..... 53/552
3,739,977 A * 6/1973 Shapiro et al. ..... 383/104
3,785,112 A * 1/1974 Leasure et al. ..... 53/551
4,004,398 A * 1/1977 Larsson et al. ..... 53/551
4,129,976 A * 12/1978 Grundler et al. ..... 53/552
4,442,656 A * 4/1984 Wylie, Sr. ..... 53/552
5,816,018 A * 10/1998 Bois ..... 53/552
5,862,652 A * 1/1999 Schoeler ..... 53/551
6,088,998 A * 7/2000 Malin et al. ..... 53/551

FOREIGN PATENT DOCUMENTS

DE 1113174 * 4/1959
EP 0729886 A1 * 9/1996
WO WO 99/38677 * 8/1999

* cited by examiner

*Primary Examiner*—John Sipos
*Assistant Examiner*—Louis Huynh
(74) *Attorney, Agent, or Firm*—Ronald E. Greigg

(57) ABSTRACT

A device for manufacturing tubular bag packages has a forming tube with a rectangular cross section. In order to produce reinforcing seams in a projection of the broad side walls of the tubular bag package, the device has a forming and folding device. The forming and folding device has two forming plates attached to the forming tube and a folding frame with folding plates. The relatively simply embodied device according to the invention makes it possible to form the reinforcing seams with less stress on the packaging material.

25 Claims, 3 Drawing Sheets

DEVICE FOR MANUFACTURING TUBULAR BAG PACKAGES

PRIOR ART

Figure 1:
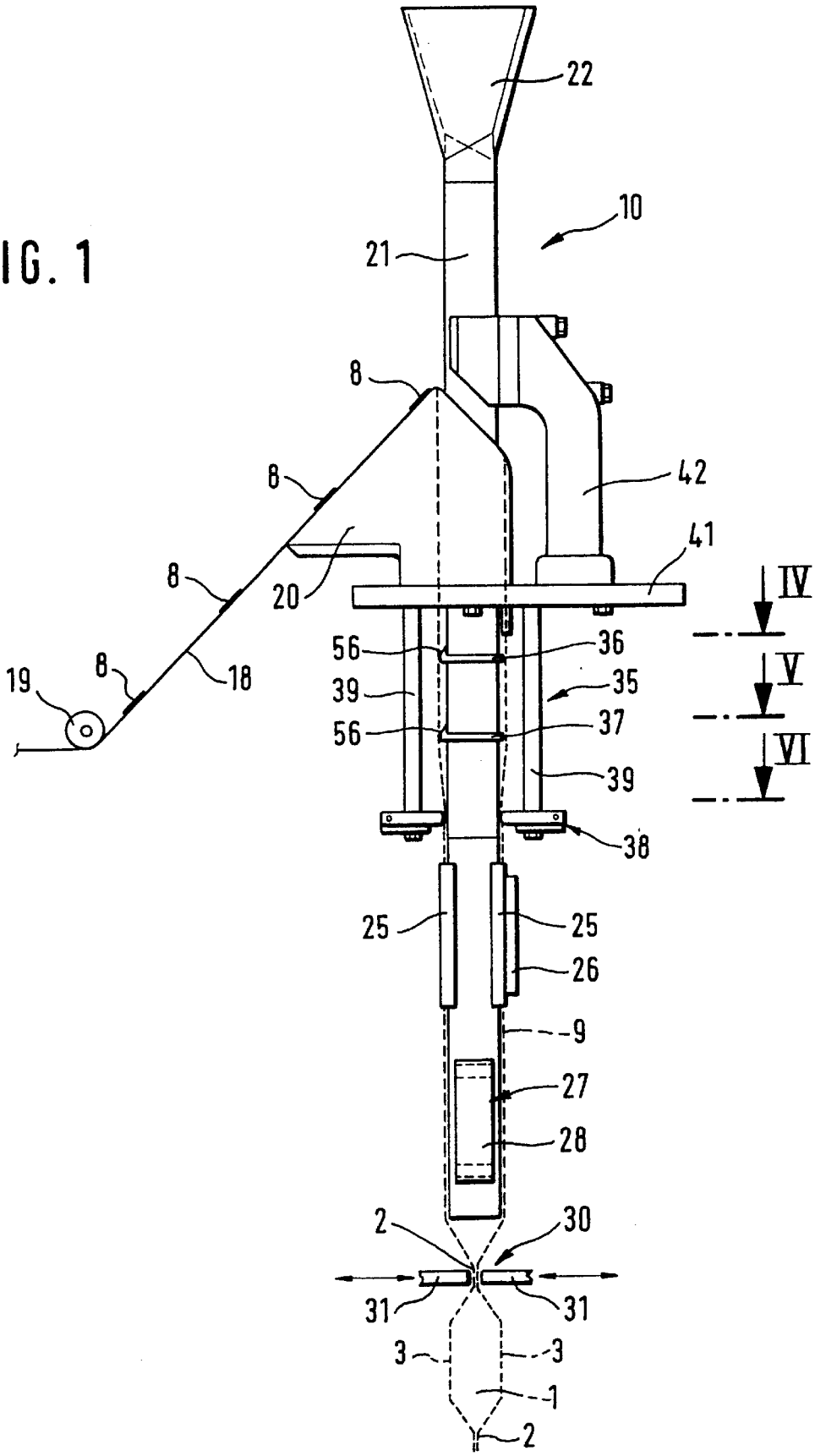

The invention relates to a device for manufacturing tubular bag packages such as disclosed by EP 0 627 355 B1. In the known device, spreading elements that protrude radially outward are fastened to the rounded longitudinal edges of the forming tube and in the vicinity of these spreading elements, the side walls of the previously longitudinally sealed tube are bowed outward from their plane. In the outwardly bowed regions of the side walls of the tube, additional longitudinal seams are then sealed, which serve to make the tubular bag package rigid. The formation of outwardly bowed regions of the tubular bag package therefore takes place from the direction of the forming tube outward from the tube interior.

Furthermore, DE-PS 11 13 174 has disclosed the concept of situating block-shaped forming elements on the outside of one or two packaging material webs and these forming elements, together with forming plates that change in cross section in the transport direction of the packaging material web(s), mold the soon-to-be-welded corner regions of the tubular bag package into the packaging material webs from the outside. The advantage of this embodiment is that lateral to the transport direction, no tensile stresses or very slight ones are generated in the packaging material web(s). However, no indication is given as to how a process of this kind is to be used in a tubular bag machine that has a forming shoulder for producing a tube.

ADVANTAGES OF THE INVENTION

The device according to the invention for manufacturing tubular bag packages, has the advantage over the prior art that with low strain on the packaging material, i.e. without significant stresses being generated in the packaging material, reinforcing seams in the corner regions of the tubular bag packages can be manufactured with a device that is relatively simple in design, wherein the reinforcing seams are produced in the projection of the side walls of the tubular bag packages.

Other advantages and advantageous improvements of the device according to the invention for manufacturing tubular bag packages ensue from the claims and the description.

BRIEF DESCRIPTION THE DRAWINGS

An exemplary embodiment of the invention is shown in the drawings and will be explained in detail below.

Figure 2:
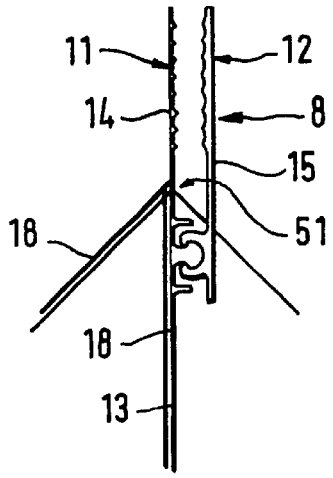
Figure 3:
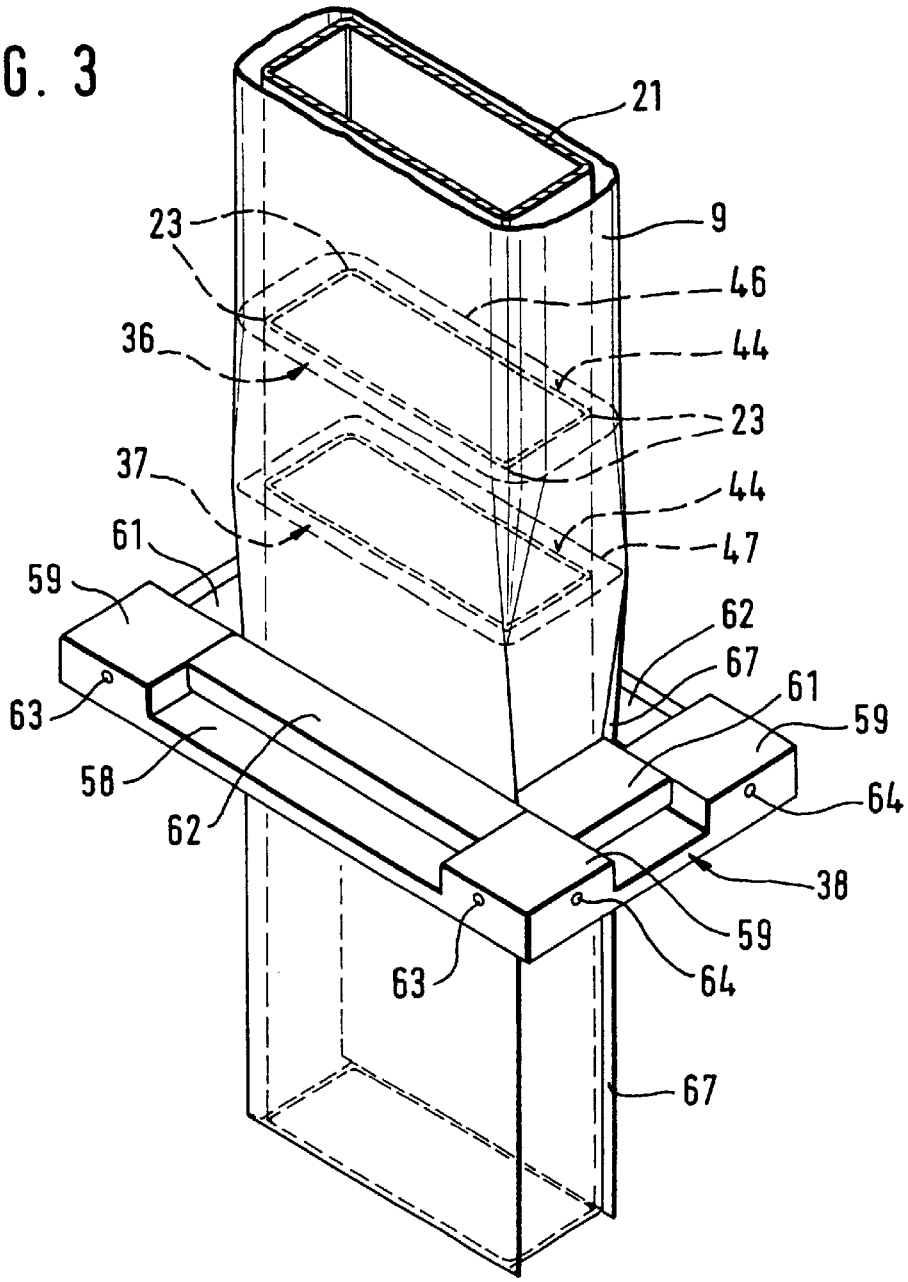
Figure 5:
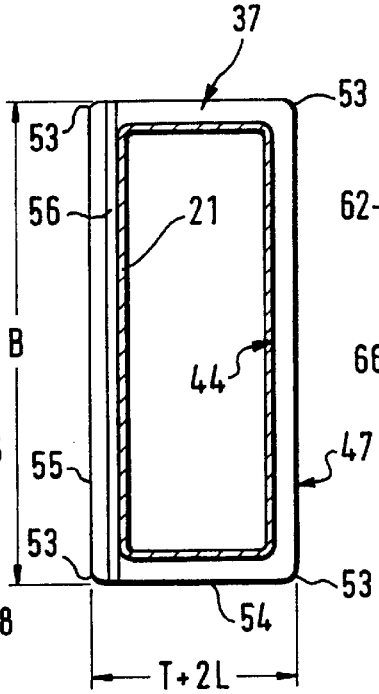
Figure 6:
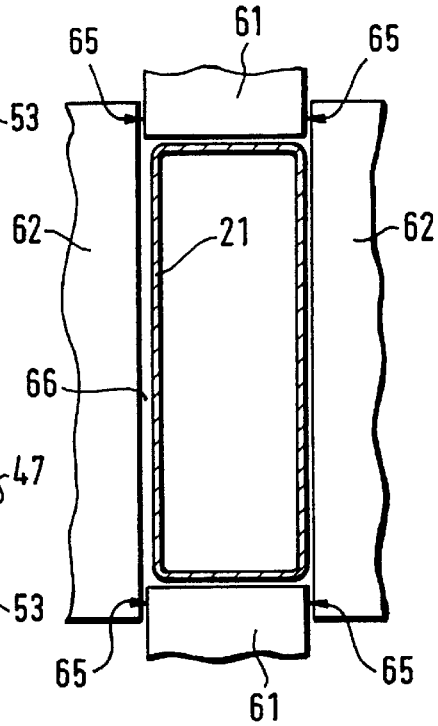
Figure 7:
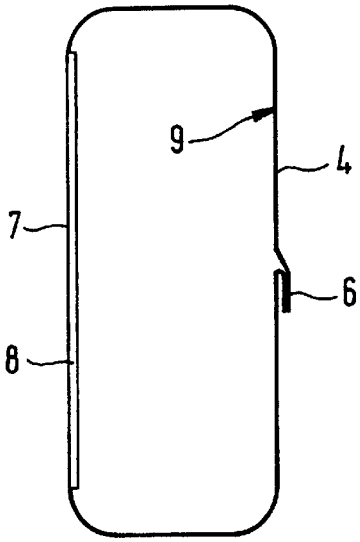
Figure 8:
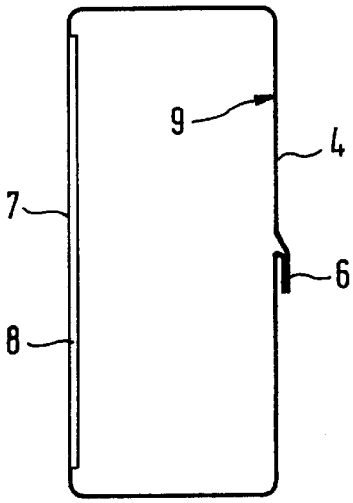
Figure 9:
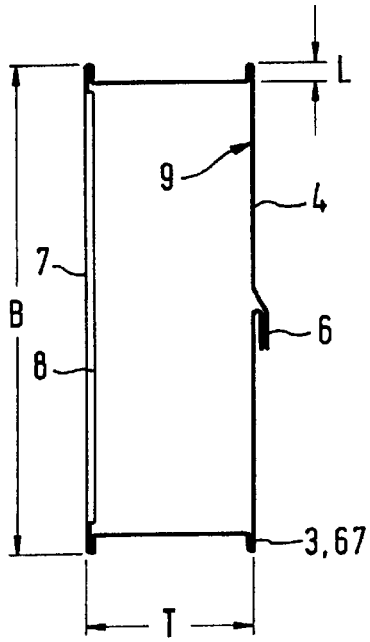

FIG. 1 shows a simplified side view of a device for manufacturing tubular bag packages, FIG. 2 shows a detail from FIG. 1 in the vicinity of the forming shoulder, FIG. 3 shows a simplified, perspective, partially sectional view of a tube forming part of the device according to FIG. 1, FIGS. 4 to 6 show sectional views in planes IV to VI of FIG. 1, FIGS. 7 and 8 show cross sections through the packaging material tube in the vicinity of the forming plates, and FIG. 9 shows a cross section through the packaging material tube in the vicinity of the folding frame.

DESCRIPTION OF THE EXEMPLARY EMBODIMENT

In FIG. 1, a device for manufacturing tubular bag packages 1 is labeled with the reference numeral 10. The tubular bag packages 1, which have an essentially rectangular cross sectional area, are closed by means of a respective lateral seam 2 at their top and bottom end. Also, in each of the four corner regions of the tubular bag package 1, a reinforcing edge 3 is formed, which extends in the longitudinal direction of the tubular bag package 1 and is disposed in the projection of the broad side walls 4, 7. Furthermore, a fin-shaped longitudinal seam 6 (FIGS. 7 to 9) is disposed on the one broad side wall 4 of the tubular bag package 1 and on the inside of the opposite broad side wall 7, a so-called zip strip 8 is disposed, which serves in a known manner as a resealable closure, and when the tubular bag package 1 is finished, is disposed underneath the upper lateral seam 2 in the top region of the tubular bag package 1.

The intrinsically known zip strip 8 is comprised of two cooperating parts 11, 12, of which the one part 11 is embodied so that it extends opposite the other part 12 with a first sealing region 13 and a second sealing region 14. The other part 12 also has a sealing region 15 (FIG. 2). The zip strips 8, which are cut into sections corresponding to the width minus the reinforcing edges 3 of the tubular bag package 1, are fastened ahead of time with their first sealing region 13 to a heat-sealable packaging material web 18 at distances that corresponds to the length of the tubular bag packages 1. The manner in which this can be executed is described, for example, in DE 298 088 17.7. The packaging material web 18 prepared in this manner, which is taken from a storage role not shown, is supplied to the device 10 via a deflecting role 19.

The device 10 has a forming shoulder 20 which forms the flat packaging material web 18 into a tube 9. The forming shoulder 20 encloses a forming and filling tube 21, which has a fill funnel 22 on its upper end. In the exemplary embodiment, the forming and filling tube 21 has a rectangular cross sectional form over its entire length that corresponds to the cross section of the tubular bag package 1 with rounded longitudinal edges 23. In addition, in each of the four corner regions of the forming and filling tube 21, longitudinal edge sealing devices 25 are disposed on the forming and filling tube 21 in the feed direction of the tube 9 in order to produce the reinforcing edges 3 and a longitudinal seam sealing device 26 is disposed at the same height on the side opposite the zip strip 8 in order to produce the longitudinal seam 6. Beneath the longitudinal edge sealing devices 25 and the longitudinal seam sealing device 26, there is a tube advancing device 27 in the form of two vacuum advancing belts 28 disposed on opposite sides of the forming and filling tube 21, of which only one vacuum advancing belt 28 can be seen in FIG. 1. Finally, underneath the forming and filling tube 21, there is a lateral seam sealing device 30 with two lateral seam sealing jaws 31 that can move in relation to each other, into which a cutting device, not shown, is integrated in order to cut individual tubular bag packages 1 from the tube 9. The longitudinal edge sealing devices 25, the longitudinal seam sealing device 26, the tube advancing device 27, and the lateral seam sealing device 30 are intrinsically known, conventional devices and thus are not described in detail.

What is essential to the invention is the disposition and embodiment of a forming and folding device 35 for the tube 9, which device is disposed on the forming and filling tube 21 between the forming shoulder 20 and the longitudinal edge sealing devices 25, 26. The forming and folding device 35 includes two forming plates 36, 37 fastened one beneath the other to the forming and filling tube 21 as well as a folding frame 38 disposed underneath the forming plates 36, 37. Whereas the forming plates 36, 37 are encompassed by the tube 9 and are thus connected to the forming and filling tube 21, for example by means of being welded to it, in contrast, the folding frame 38 encompasses of the tube 9 from the outside. To that end, the folding frame 38 is connected by means of rods 39 to an intermediary plate 41, which is disposed at the level of the forming shoulder 20 and is in turn connected to a support 42 on the forming and filling tube 21, above the forming shoulder 20.

Figure 4:
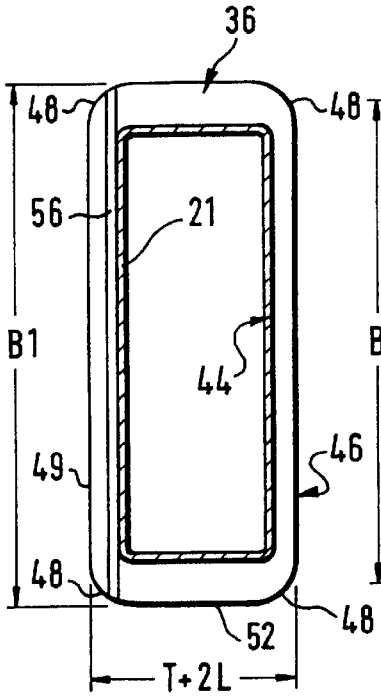

As can best be seen in FIGS. 3 to 5, the two forming plates 36, 37 have an equivalent inner contour 44, which is adapted to the cross section of the forming and filling tube 21, as well as essentially rectangular outer contours 46, 47. The outer contour 46 of the upper forming plate 36 thereby corresponds to the contour of the packaging material tube 9 formed by the forming shoulder 20. This means that there are relatively heavily rounded corners 48. Furthermore, the width B1 of the wide outer edge 49 between the rounded corners 48 is preferably of such a magnitude that it approximately corresponds to the length of the zip strip 8 since the zip strip 8 must then be bent or bowed only slightly in its edge regions when the packaging material web 18 is deflected at the upper shoulder edge 51 of the forming shoulder 20 (FIG. 2). The length of the narrow outer edges 52 of the forming plate 36 corresponds to T+2L, where T is the bag depth or bag thickness of a tubular bag package 1 and L is the width of a reinforcing edge 3 of the tubular bag package 1 (FIG. 9).

By contrast, the lower forming plate 37 has only slightly rounded corners 53, wherein the length of the narrow outer edges 54 is in turn T+2L, whereas the length B of the wide outer edges 55 is less than B1 due to the lack of more heavily rounded corners 48 in comparison to the forming plate 36. Furthermore, the length B corresponds to the bag width of the finished tubular bag package 1 with reinforcing edges 3 (FIG. 9). Since the circumferences of the outer contours 46, 47 of the two forming plates 36, 37 are identical, the tube 9 is only changed in its cross sectional form in the feed direction; however, no lateral stresses occur in the tube 9 so that the tube 9 rests completely against both of the outer contours 46, 47. Moreover, an inclined deflector 56 is respectively disposed on the two forming plates 36, 37 on the wide outer edge 49, 55 oriented toward the zip strip 8 and these deflectors prevent the zip strip 8 from catching when the tube 9 is fed over the two forming plates 36, 37.

The folding frame 38 disposed beneath the two forming plates 36, 37 has a folding plate support 58 with four raised corner regions 59. Two short folding plates 61 and two long folding plates 62 are supported so they can pivot on axles 63, 64 in the corner regions 59. The ability of the folding plates 61, 62 to pivot makes it possible to pull the tube 9 manually through the region of the folding frame 38, for example at the beginning of production. As can be seen from FIGS. 3 and 6, the folding plates 61, 62 protrude toward the forming and filling tube 21; a gap is formed between the folding plates 61, 62 and the forming and filling tube 21. In this connection, the folding plates 61, 62 completely encompass the forming and filling tube 21; the wide folding plates 62 extend laterally beyond the forming and filling tube 21 so that the short folding plates 61 protrude into overlapping regions 65 between the long folding plates 61. In the overlapping regions 65, a gap is formed between the folding plates 61 and 62 and its width corresponds to at least the thickness of two layers of the packaging material web 18. Furthermore, FIG. 6 shows that between the one side of the forming and filling tube 21 and the one long folding plate 62, an intermediary space 66 is produced which is wider than the other gaps in relation to the forming and filling tube 21. This intermediary space 66 is used for the passage of the zip strip 8 when the tube 9 is fed through the region of the folding frame 38.

The device 10 operates as follows: the flat packaging material web 18, which is provided with the zip strips 8 and is cyclically advanced by the vacuum advance belts 28, is formed into the tube 9 by the forming shoulder 20, wherein the packaging material web 18 overlaps with its opposite edge regions in the vicinity of the longitudinal seam 6 that will be produced later. The tube 9 thus formed by the forming shoulder 20 travels without cross sectional alteration into the vicinity of the upper forming plate 36. Between the upper forming plate 36 and lower forming plate 37, the cross section of the tube 9 is then changed from the outer contour 46 to the outer contour 47 of the lower forming plate 37 and the circumference lengths of the two outer contours 46, 47 are equal so that no stresses are generated in the tube 9 lateral to the feed direction.

Then the tube 9 travels from the lower forming plate 37 into the region of the folding frame 38. While the circumference length of the tube 9 remains the same, the cross section of the tube 9 changes in such a way that its width is reduced from B to the width B−2L of the forming and filling tube 21 or is reduced by the distance between the two narrow folding plates 61. This occurs by folding over the corner regions of the tube 9 between the lower forming plate 37 and the folding frame 38 (FIG. 3), wherein the folded-over regions 67 that subsequently constitute the reinforcing edges 3 have their final width L in the overlapping regions 65 of the folding plates 61, 62. After passing the folding frame 38, the regions 67 and the region of the tube 9 that constitutes the longitudinal seam 6 pass between sealing surfaces of the longitudinal edge sealing devices 25 and the longitudinal seam sealing device 26 where, through the action of heat and pressure, the longitudinal seam 6 and the reinforcing seams 3 are formed. The longitudinally sealed tube 9 thus formed, after the formation of a bottom lateral seam 2 by means of the lateral seam sealing device 30, is filled with the filling by means of the forming and filling tube 21. Finally, in a subsequent stop phase after the formation of a top lateral seam 2, wherein the two sealing regions 14, 15 are also simultaneously welded to the inside of the tube 9, a tubular bag package 1 is respectively cut from the tube 9.

It should also be mentioned that the position of the forming plate 37 is preferable in which the outer edge 54 represents a contact line for the tube 9 between the outer edge 52 of the forming plate 36 and the side of the folding plate 61 oriented toward the forming and filling tube 21 so that there is no deflection of the tube 9 around the outer edge 54. Furthermore, the folding plates 61, 62 can also be replaced by rolling elements which correspondingly guide and fold the tube 9 on the forming and filling tube 21.

Finally, it should be mentioned that the device 10 according to the invention is naturally also suitable for manufacturing tubular bag packages 1 without zip strips 8. In this case, the deflectors 56 on the two forming plates 36, 37 and also the intermediary space 66 in the folding frame 38 can be eliminated. In addition, the device 10 can also be driven continuously instead of cyclically, for which the lateral seam sealing device 30 and the longitudinal seam sealing device 36 must be modified in a known manner.

The foregoing relates to a preferred exemplary embodiments of the invention, it being understood that other variants and embodiments thereof are possible within the spirit and scope of the invention, the latter being defined by the appended claims.

We claim:

1. A device (10) for manufacturing tubular bag packages (1) that have an essentially rectangular cross sectional area with reinforcing seams (3) formed in corner regions and a longitudinal seam (6) disposed in a side wall (4), said device comprising: a forming shoulder (20) for forming a packaging material tube (9) from a flat sheet (18), a longitudinal seam sealing device (26) for producing the longitudinal seam (6), longitudinal edge sealing devices (25) for producing the reinforcing seams (3), a forming and filing tube (21), a tube advancing device (27), a lateral seam sealing device (30) for producing lateral seams (2), a cutting device for cutting the individual tubular bag packages (1) from the packaging material tube (9), and a forming device (35) for producing fin-shaped tube corner regions (67), which constitute the reinforcing seams (3), the forming device (35) has folding elements (61, 62) which act on the packaging material tube (9) exclusively from an outside and in so doing, press the packaging material tube (9) against each other in the vicinity of the tube corner regions (67), wherein the folding elements (61, 62) are preceded by at least one forming plate (37) secured to and surrounds the exterior of the forming and filing tube (21), which plate has an essentially rectangular shape with curved corners (53), of which an edge length (B) corresponds to the width (B) of the finished tubular bag packages (1) together with the reinforcing seams (3), and wherein the other edge length thereof (T+2L) corresponds to the depth (T) of the tubular bag packages (1) plus the length (L) of the two reinforcing seams (3).

2. The device according to claim 1, wherein the folding elements are embodied as sets of folding plates (61, 62) which completely encompass the forming and filing tube (21) on a circumference of the forming and filing tube, so as to form a continuous gap therebetween, and that the sets of folding plates (61, 62) are disposed on a common folding frame (38) that encompasses the forming and filing tube (21).

3. The device according to claim 2, wherein the sets of folding plates (61, 62) are disposed so that the folding plates of each set pivot on the folding frame (38).

4. The device according to claim 3, wherein one set of folding plates (62) extend beyond side walls of the forming and filing tube (21) associated with the one set of folding plates (62) so that overlapping regions (65) are formed with another set of folding plates (61) and wherein the tube corner regions (67) of the packaging material tube (9) are guided in these overlapping regions.

5. The device according to claim 4, wherein the tubular bag package (1) has a zip strip (8) in a top region, that extends lateral to a longitudinal direction and wherein between the forming and filing tube (21) and one set of folding plates (62), an intermediary space (66) is formed for a passage of the zip strip (8).

6. The device according to claim 3, wherein the tubular bag package (1) has a zip strip (8) in a top region, that extends lateral to a longitudinal direction and wherein between the forming and filing tube (21) and one set of folding plates (62), an intermediary space (66) is formed for a passage of the zip strip (8).

7. The device according to claim 3, wherein said at least one forming plate includes two forming elements (36, 37) fastened one beneath the other to the forming and filing tube (21) and wherein, at least in the vicinity of the folding elements (61, 62) and the forming elements (36, 37), the forming and filing tube (21) has a constant, rectangular cross sectional area.

8. The device according to claim 7, wherein the forming elements (36, 37) are fastened to the forming and filing tube (21) and have outer contours (46, 47) with circumference lengths that correspond to a circumference length of the tubular bag package (1), and wherein a forming plate (36) nearest the forming shoulder (20) has a same cross sectional form as the packaging material tube (9) formed by the forming shoulder (20).

9. The device according to claim 8, wherein a deflector (56) for a zip strip (8) is disposed on a side of the forming elements (36, 37) oriented toward the zip strip (8).

10. The device according to claim 3, wherein the longitudinal seam sealing device (26) and the longitudinal edge sealing devices (25) are disposed on and in the same area of the forming and filing tube (21).

11. The device according to claim 2, wherein one set of folding plates (62) extend beyond side walls of the forming and filing tube (21) associated with the one set of folding plates (62) so that overlapping regions (65) are formed with another set of folding plates (61) and wherein the tube corner regions (67) of the packaging material tube (9) are guided in these overlapping regions.

12. The device according to claim 11, wherein the tubular bag package (1) has a zip strip (8) in a top region, that extends lateral to a longitudinal direction and wherein between the forming and filing tube (21) and one set of folding plates (62), an intermediary space (66) is formed for a passage of the zip strip (8).

13. The device according to claim 11, wherein said at least one forming plate includes two forming elements (36, 37) fastened one beneath the other to the forming and filing tube (21) and wherein, at least in the vicinity of the folding elements (61, 62) and the forming elements (36, 37), the forming and filing tube (21) has a constant, rectangular cross sectional area.

14. The device according to claim 13, wherein the forming elements (36, 37) are fastened to the forming and filing tube (21) and have outer contours (46, 47) with circumference lengths that correspond to a circumference length of the tubular bag package (1), and wherein a forming plate (36) nearest the forming shoulder (20) has a same cross sectional form as the packaging material tube (9) formed by the forming shoulder (20).

15. The device according to claim 14, wherein a deflector (56) for a zip strip (8) is disposed on a side of the forming elements (36, 37) oriented toward the zip strip (8).

16. The device according to claim 11, wherein the longitudinal seam sealing device (26) and the longitudinal edge sealing devices (25) are disposed on and in the same area of the forming and filing tube (21).

17. The device according to claim 2, wherein the tubular bag package (1) has a zip strip (8) in a top region, that extends lateral to a longitudinal direction and wherein between the forming and filing tube (21) and one set of folding plates (62), an intermediary space (66) is formed for a passage of the zip strip (8).

18. The device according to claim 17, wherein said at least one forming plate includes two forming elements (36, 37) fastened one beneath the other to the forming and filing tube (21) and wherein, at least in the vicinity of the folding elements (61, 62) and the forming elements (36, 37), the forming and filing tube (21) has a constant, rectangular cross sectional area.

19. The device according to claim 18, wherein the forming elements (36, 37) are fastened to the forming and filing tube (21) and have outer contours (46, 47) with circumference lengths that correspond to a circumference length of the tubular bag package (1), and wherein a forming plate (36) nearest the forming shoulder (20) has a same cross sectional form as the packaging material tube (9) formed by the forming shoulder (20).

20. The device according to claim 19, wherein a deflector (56) for a zip strip (8) is disposed on a side of the forming elements (36, 37) oriented toward the zip strip (8).

21. The device according to claim 2, wherein said at least one forming plate includes two forming elements (36, 37) fastened one beneath the other to the forming and filing tube (21) and wherein, at least in the vicinity of the folding elements (61, 62) and the forming elements (36, 37), the forming and filing tube (21) has a constant, rectangular cross sectional area.

22. The device according to claim 21, wherein the forming elements (36, 37) are fastened to the forming and filing tube (21) and have outer contours (46, 47) with circumference lengths that correspond to a circumference length of the tubular bag package (1), and wherein a forming plate (36) nearest the forming shoulder (20) has a same cross sectional form as the packaging material tube (9) formed by the forming shoulder (20).

23. The device according to claim 22, wherein a deflector (56) for a zip strip (8) is disposed on a side of the forming elements (36, 37) oriented toward the zip strip (8).

24. The device according to claim 2, wherein the longitudinal seam sealing device (26) and the longitudinal edge sealing devices (25) are disposed on and in the same area of the forming and filing tube (21).

25. The device according to claim 1, wherein the longitudinal seam sealing device (26) and the longitudinal edge sealing devices (25) are disposed on and in the same area of the forming and filing tube (21).

* * * * *